United States Patent [19]

St. Aubin

[11] 4,429,493

[45] Feb. 7, 1984

[54] ASTRAGAL HOUSING SEAL AND LOCK

[75] Inventor: William R. St. Aubin, Perrysburg, Ohio

[73] Assignee: LST Corporation, Sylvania, Ohio

[21] Appl. No.: 424,220

[22] Filed: Sep. 27, 1982

[51] Int. Cl.[3] ..... E05C 7/04

[52] U.S. Cl. ..... 49/367; 49/368

[58] Field of Search ..... 49/367, 368, 369, 366

[56] References Cited

U.S. PATENT DOCUMENTS

| | | | |
|---|---|---|---|
| 3,281,177 | 10/1966 | Tenenbaum . | |
| 3,487,581 | 1/1970 | Ellingson, Jr. | 49/366 X |
| 3,649,060 | 3/1972 | Ruff | 49/368 X |
| 3,660,940 | 5/1972 | Tavano . | |
| 3,680,901 | 8/1972 | Biebuyck . | |
| 3,806,175 | 4/1974 | Van Herpen | 49/369 X |
| 3,919,808 | 11/1975 | Simmons | 49/367 |
| 3,944,266 | 3/1976 | Weaver . | |
| 4,052,819 | 10/1977 | Beischel et al. | 49/368 |
| 4,058,332 | 11/1977 | DiFazio | 49/368 X |

*Primary Examiner*—Philip C. Kannan

*Attorney, Agent, or Firm*—Emch, Schaffer & Schaub Co.

[57] ABSTRACT

An improved astragal for use in a double door assembly having an active door and a relatively inactive door is disclosed. The astragal has a vertically extending mullion housing which is attached to the free edge of the relatively inactive door. A vertically extending slide section is mounted on the mullion housing on the sealing side of the free edge of the inactive door. The slide section extends from the free vertical edge of the inactive door when the active door is in the closed position. The slide section is vertically movable from an unlocked position to a locked position wherein the slide section is moved vertically downward with respect to the mullion housing to engage the sill/threshold of the door frame, thereby preventing any movement of the inactive door.

14 Claims, 14 Drawing Figures

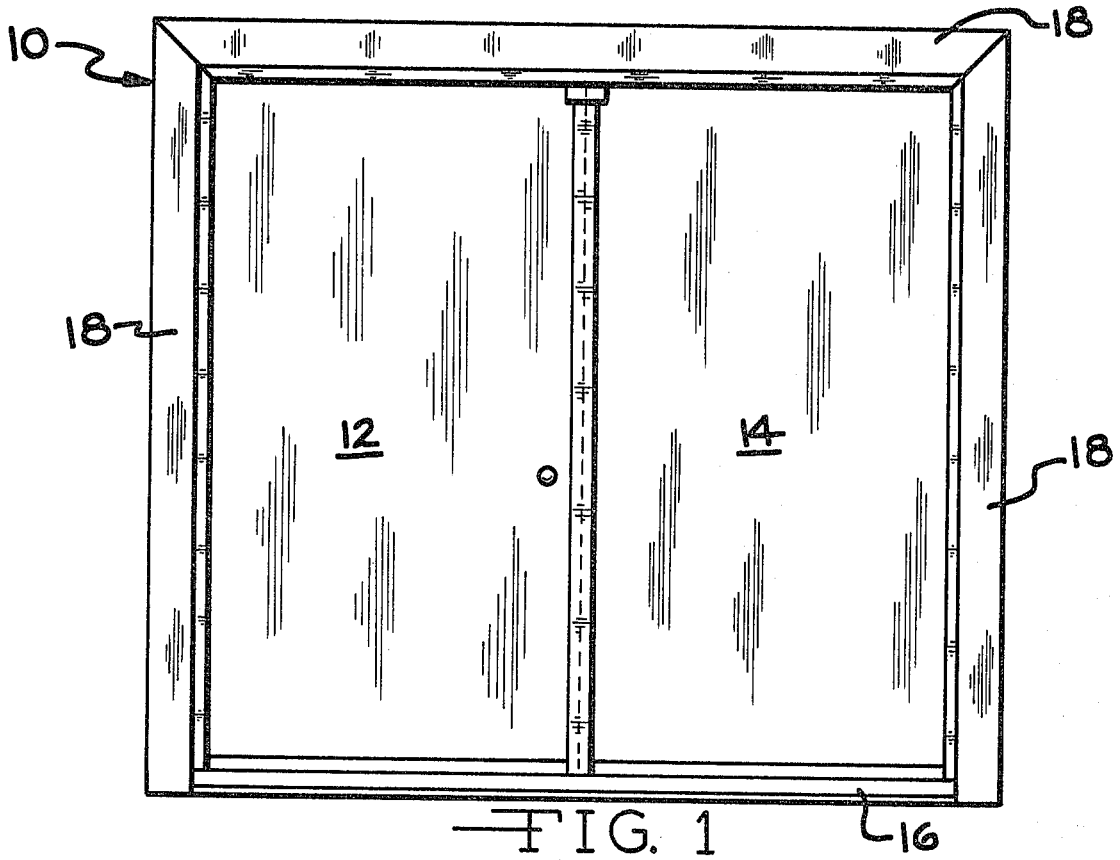
FIG. 1
FIG. 2
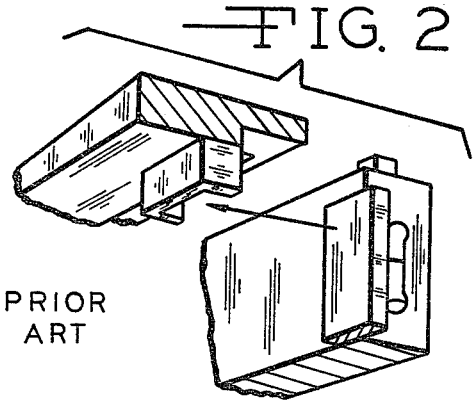
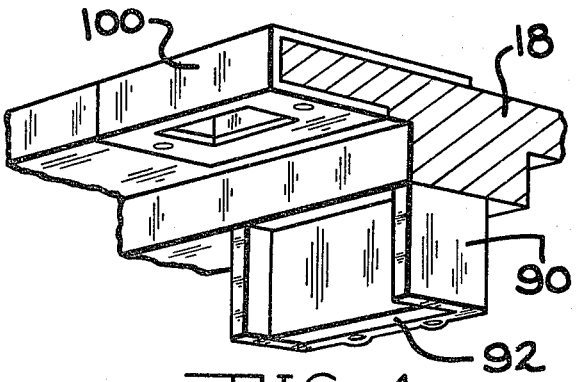
FIG. 4
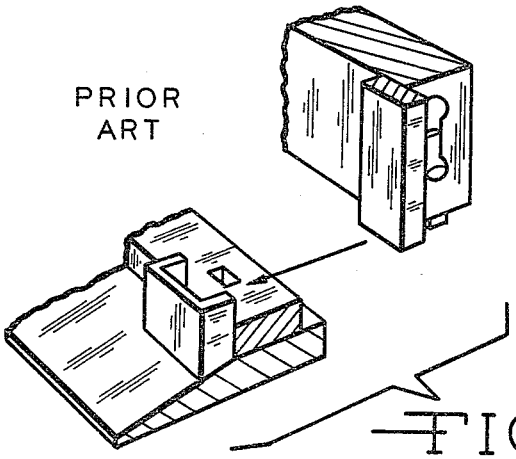
FIG. 3
FIG. 5
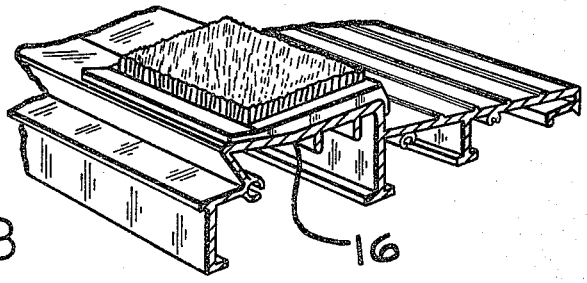

ASTRAGAL HOUSING SEAL AND LOCK

BACKGROUND OF THE INVENTION

The present invention relates to an improved astragal assembly for use with a pair of double doors, typically having one relatively inactive door and one active door mounted with their free edges adjacent one another. Other astragal assemblies, of a general nature, are shown for example in U.S. Pat. Nos. 4,058,332; 4,052,819; 3,806,175; 3,649,060; and 3,487,581.

The provision of astragals for dothe subject of continuous development in the building industry. In the present invention, an improvement in the mechanism for securing the relatively inactive door has been made. The present invention further provides an astragal assembly having an enhanced aesthetic appearance.

It is an object of this invention to provide an astragal assembly having improved security strength.

It is another object of this invention to provide an astragal assembly having an improved aesthetic appearance.

It is yet another object of this invention to provide an improved astragal assembly that provides the assembler with enhanced ease of installation and maintenance.

SUMMARY OF THE INVENTION

The invention provides an improved astragal assembly for use with double doors having one active and one relatively inactive door. A vertically extending fixed mullion housing is attached to the free vertical edge of the inactive door. The mullion housing includes a vertically moving bolt member that moves from an unlocked position to a locked position engaging a strikeplate located in the upper door frame member.

A vertically extending slide section is attached to the mullion housing on the sealing side of the inactive and/or active doors. The slide section moves vertically on the mullion housing from an unlocked to a locked position engaging the sill of the door frame. When the slide section has been vertically moved to a locked position, it prevents inward movement of the inactive door.

To keep the slide section in its locked position and prevent tampering with the slide section when in the locked position, there is a cam-activated locking latch located in the mullion housing. As the vertically moving bolt is moved into its locked position engaging the strikeplate located in the upper door frame, a cam member on the bolt engages a cam surface on the locking latch to move the locking latch in an interlocked position with the slide section, thereby preventing any movement of the slide section.

To open the relatively inactive door, the active door must be opened and the bolt member moved to an unlocked position. As the bolt member is moved to an unlocked position, the cam member on the bolt member engages the cam surface of the locking latch causing the locking latch to disengage from the slide section. After disengagement of the locking latch, the slide section is then moved upward to its unlocked position and the relatively inactive door can then be opened.

BRIEF DESCRIPTION OF THE DRAWINGS

FIG. 1 is an exterior view of a double door assembly including the sill/threshold, surrounding frame and improved astragal.

FIG. 2 is a detailed view of the top portion of a prior art astragal.

FIG. 3 is a detailed view of the bottom portion of a prior art astragal.

FIG. 4 is a detailed view of the top boot and strikeplate of the present invention located in the upper door frame.

FIG. 5 is a detailed view of one of the thresholds of the double door for use with the present invention.

DETAILED DESCRIPTION OF THE DRAWINGS

Figure 7:
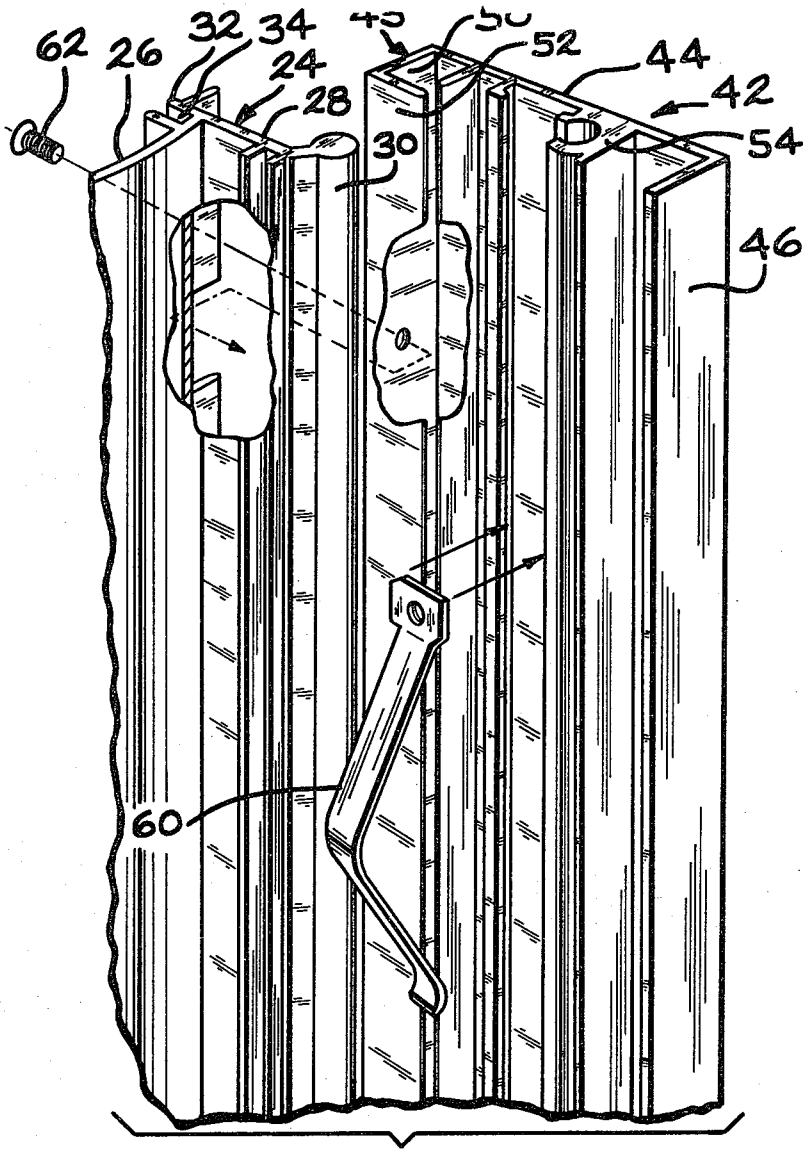
FIG. 7 is a detailed view of the astragal of the present invention, detailing the resilient leaf spring and the slide section stop.

The present invention discloses an improved astragal for use with a double door assembly, such as French doors as shown in FIG. 1. The double door assembly 10 includes an active door 12 and a relatively inactive door 14 mounted over a sill/threshold 16 in a surrounding frame 18. The free vertical edge 20 of the active door 12 and the free vertical edge 22 of the relatively inactive door 14 are adjacent each other.

Figure 6:
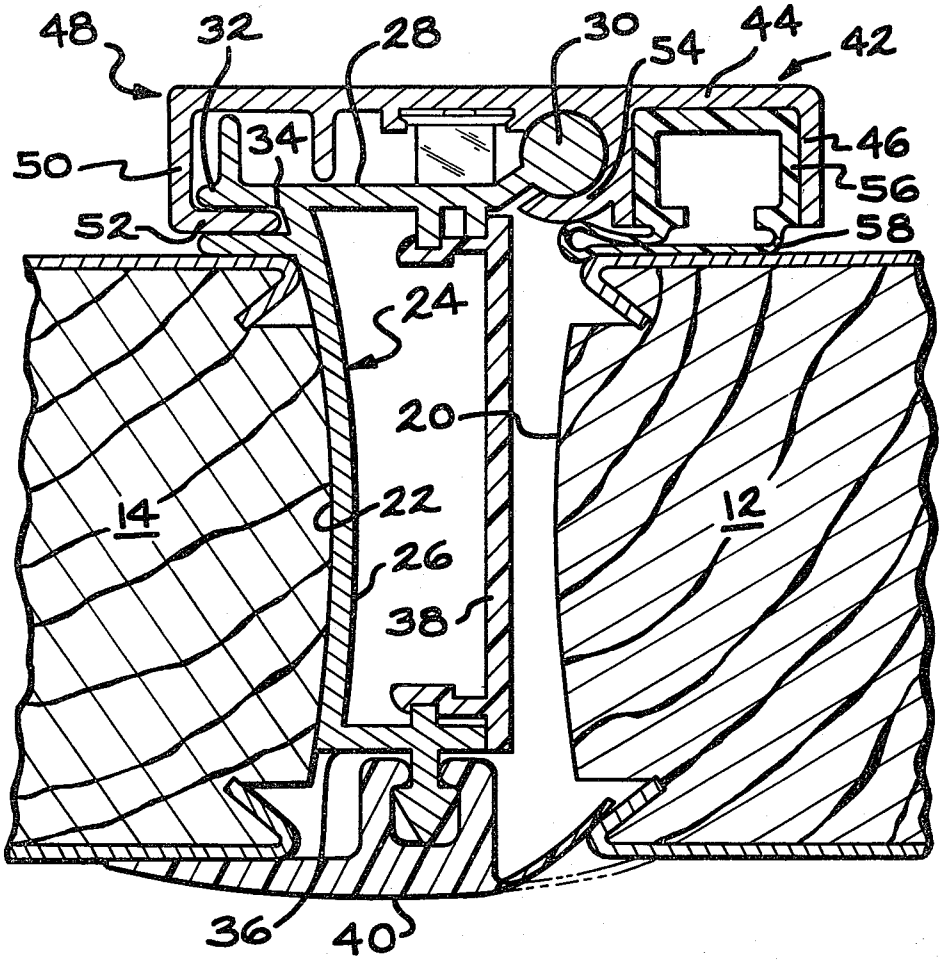
FIG. 6 is a top view of the astragal of the present invention positioned between the relatively inactive door and the active door.
Figure 8:
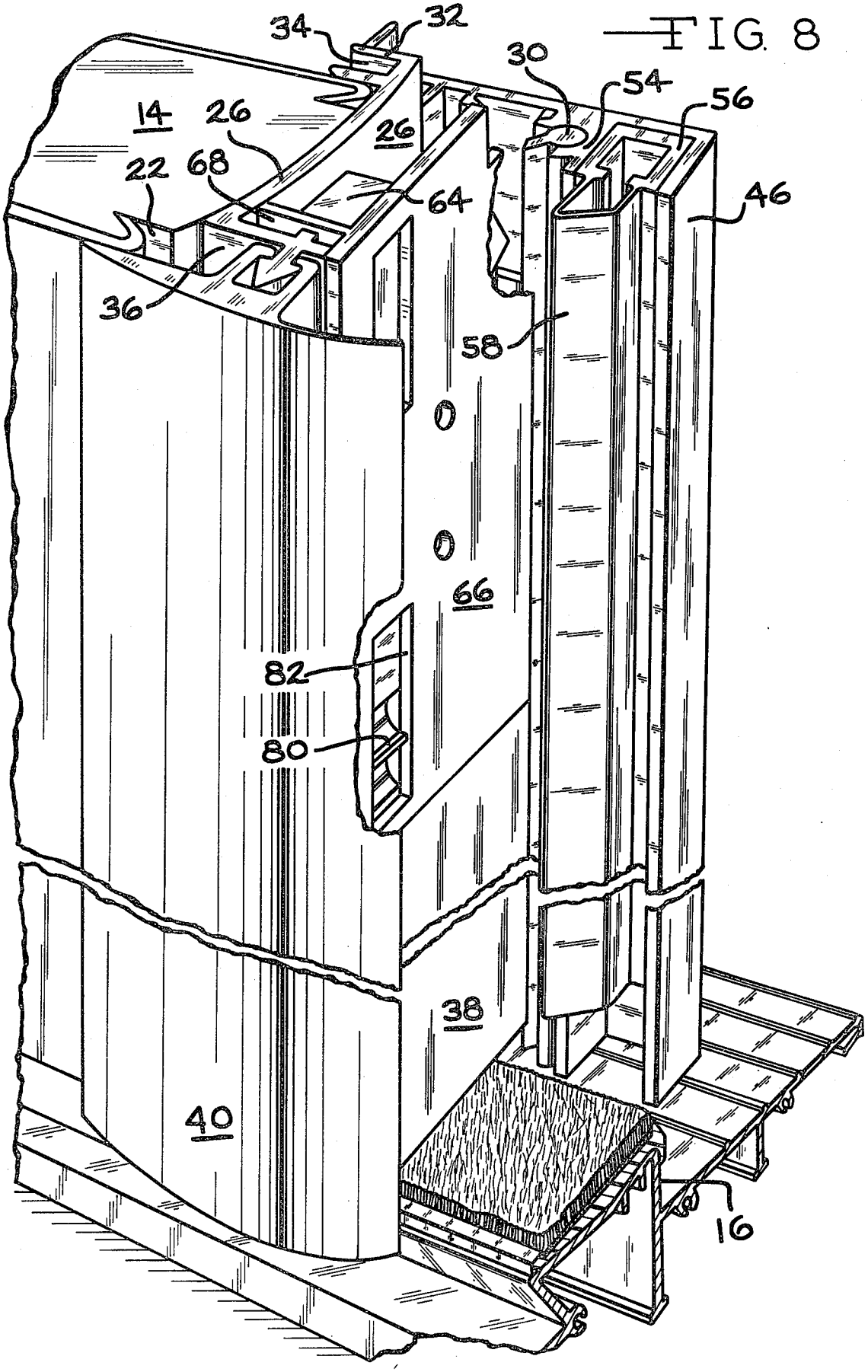
FIG. 8 is a perspective view of the astragal of the present invention with the slide section in the unlocked position.

Referring now to FIGS. 6, 7 and 8, the improved astragal has a mullion housing 24 mounted on the free vertical edge 22 of the relatively inactive door 14. A vertically extending base member 26 of the mullion housing 24 is attached by conventional methods to the free vertical edge 22 of the inactive door 14. The base member 26 has a first elongated leg 28 integrally formed along the full vertical length of the base member 26. The first elongated leg 28 extends outwardly from the free vertical edge 22 of the inactive door 14 and ends in an enlarged vertically extending ball member 30.

The base member 26 also has an elongated channel 32, which is integrally formed along the full vertical length of the base member 26 adjacent the exterior side of the inactive door 14. The elongated channel 32 forms a vertically extending slot 34. Referring specifically now to FIGS. 6 and 7, it is preferred that the slot 34 opens in an opposed direction to the first elongated leg 28 and vertically extending ball member 30.

The mullion housing 24 has a second elongated leg 36 integrally formed along the full vertical length of the base member 26. The second elongated leg 36 is located adjacent the back of the free vertical edge 22 of the inactive door 14 and extends outwardly in a position substantially parallel to the first elongated leg 28.

A snap-in mullion cap 38 is attached to the mullion housing 24 and extends across the space between the first elongated leg 28 and the second elongated leg 36, thereby providing a decorative trim for the mullion housing 24.

A vertically extending trim piece 40 is also attached to the second elongated leg 36 and is provided to extend across and seal the gap between the relatively inactive door 14 and the active door 12 when the active door 12 is in its closed position.

Referring again to FIGS. 6, 7 and 8, a vertical slide section 42 is shown. The vertical slide section 42 has a vertically extending facing member 44 which is spaced from the sealing side of the inactive door 14 and the sealing side of the active door 12 when the active door 12 is in the closed position, thereby extending across the gap between the inactive door 14 and the active door 12. The sealing sides of the doors shown in FIG. 1 are the exterior sides of the doors in that embodiment. However, in other embodiments, the sealing sides are not necessarily the exterior sides. In still other embodiments the doors may be located in interior spaces.

The vertical slide section 42 includes a first elongated facing leg 46 integrally formed along the vertical length of the facing member 44. The first facing leg 46 projects toward the sealing side of the active door 12, ending at a point adjacent the sealing side of the active door 12.

A second elongated facing leg 48 is also integrally formed along the vertical length of the facing member 44 and is located adjacent the sealing side of the inactive door 14. The second elongated facing leg 48 has a first elongated side 50 projecting from the facing member 44 along the full length of the facing member 44, towards the sealing side of the active door 12. A second elongated side 52 is integrally formed with the first elongated side 50, vertically extending the full length of the first elongated side 50, adjacent the sealing side of the inactive door.

A vertically extending socket member 54 is integrally formed with the facing member 44 along the full vertical length of the facing member 44, of the slide section 42 and is positioned between the first elongated facing leg 46 and second elongated facing leg 48. To mount the slide section 42 on the mullion housing 24, the socket member 54 of the slide section 42 engages the vertically extending ball member 30 of the mullion housing 24 and the vertically extending slot 34 of the mullion housing 24 engages the second elongated side 52 of the second elongated facing leg 48 of the slide section 42.

The vertical slide section 42 includes a vertically extending seal 56 fixed adjacent the first elongated facing leg 46, the facing member 44 and the socket member 54. The seal 56 has a flexing member 58 to engage the sealing side of the active door 12 when the active door 12 is in the closed position.

Further included in the slide section 42 is a leaf spring 60. The leaf spring 60 is resiliently flexed to engage the first elongated leg 28 of the mullion housing 24. As the slide section 42 is moved with respect to the mullion housing 24, the resilient leaf spring 60 exerts pressure between the slide section 42 and the mullion housing 24 to facilitate positioning of the slide section 42 in any desired position with respect to the mullion housing 24.

As shown in FIG. 7, a set screw 62 is also provided to limit the vertical movement of the slide section 42 with respect to the mullion housing 24.

Figure 9:
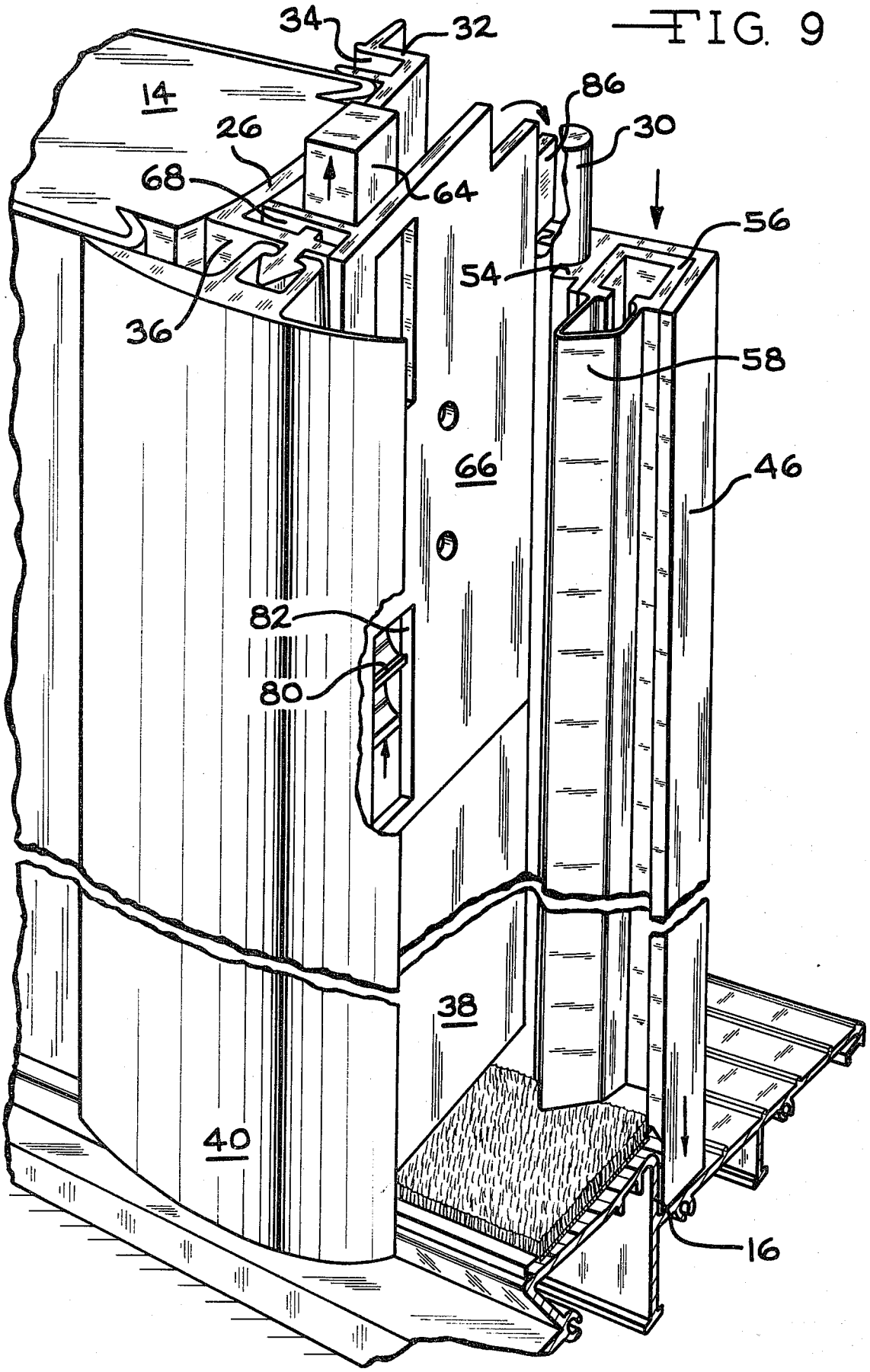
FIG. 9 is a perspective view of the astragal of the present invention with the slide section in the locked position engaging the sill of the door frame.
Figure 10:
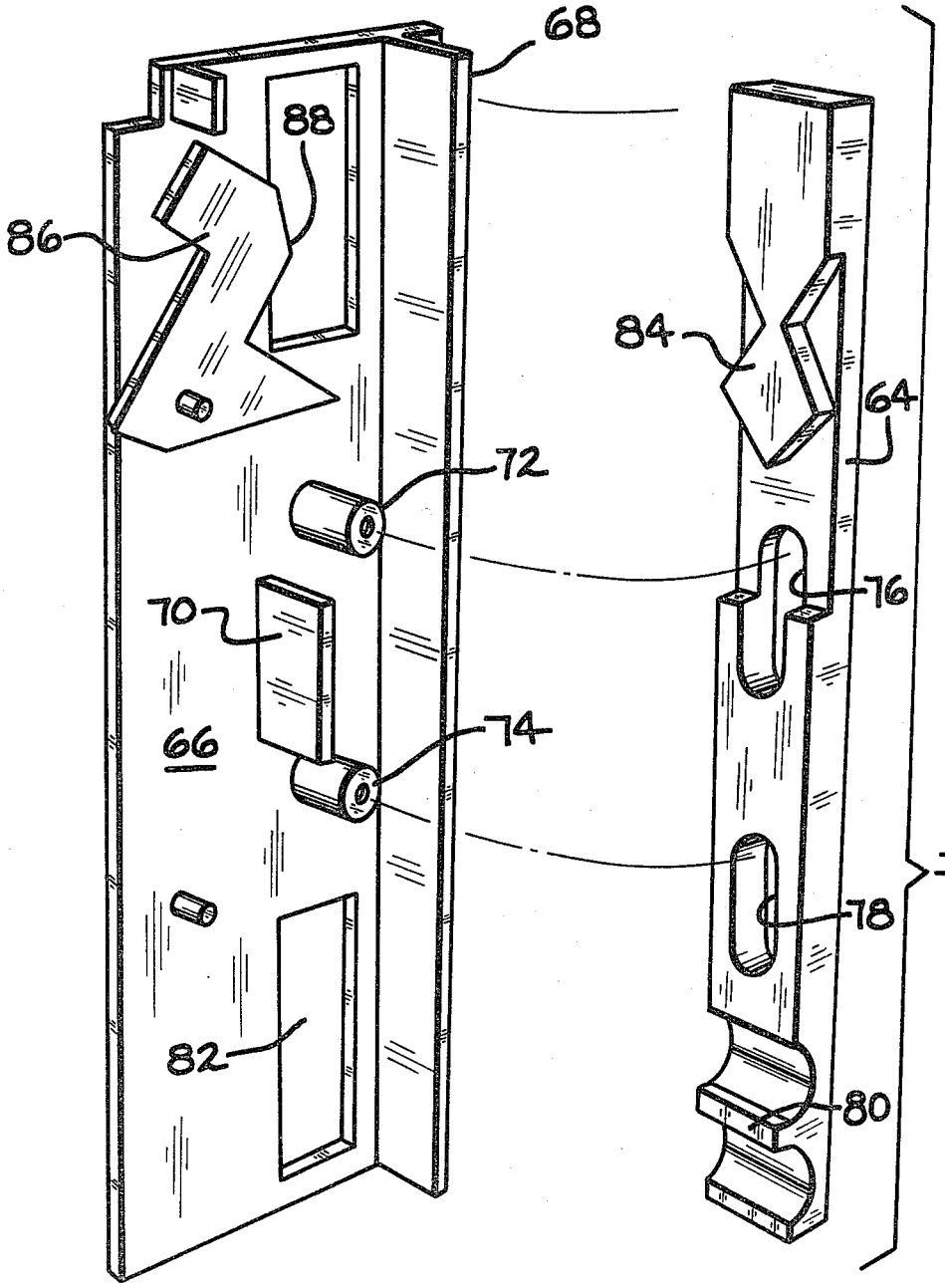
FIG. 10 is a detailed view of the bolt member and guide plate of the present invention.

Referring now to FIGS. 9, 10, 11, and 12, the various locking mechanisms used to secure the astragal assembly will be described. Positioned in the mullion housing 24, adjacent the top portion of the relatively inactive door 14, is a bolt member 64 retained in a guide plate 66. The guide plate 66, in the preferred embodiment, is contiguous with the mullion cap 38 as shown in FIGS. 8 and 9. The guide plate 66 has a first spacing member 68 and a second spacing member 70 for retaining the bolt member 64 in an aligned position between the guide plate 66 and the base member 26 of the mullion housing 24.

First and second guide pins 72, 74 are between the first and second spacing members 68, 70 and engage first and second apertures 76, 78 located in the bolt member 64.

A finger grip 80 for moving the bolt member 64 vertically with respect to the guide plate 66 is accessible through the guide plate aperture 82.

Figure 11:
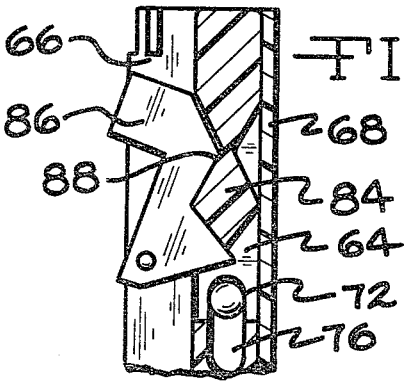
FIG. 11 is a detailed view of cam member of the bolt engaging the cam surface of the locking latch in an unlocked position.
Figure 12:
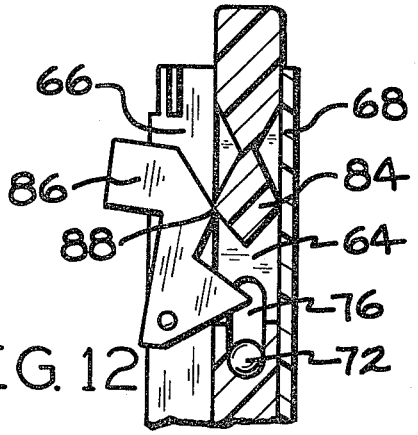
FIG. 12 is a detailed view of the cam member of the bolt engaging the cam surface of the locking latch in a locked position.

The bolt member 64 further includes a cam member 84 for engaging a locking latch 86 having a cam surface 88. As shown in FIGS. 11 and 12, as the bolt member 64 is moved to a locked position engaging the upper door frame 18, the cam member 84 of the bolt member 64 engages the cam surface 88 of the locking latch 86, thereby placing the locking latch 86 into an interlocked position with the slide section 42. As shown in FIG. 9, the locking latch 86 engages the very top of the vertical slide section 42 to lock the slide section 42 in its interlocked position with the sill 16 of the double door assembly 10. The slide section 42 is then prevented from movement in any direction. As the bolt member 64 is moved to its unlocked position of non-engagement with the door frame 18, the cam member 84 engages the cam surface 88 of the locking latch 86, thereby placing the locking latch 86 into a non-interlocking position with respect to the slide section 42.

To complete the construction of the astragal assembly, a top boot 90, as shown in FIG. 4 is fixed to the upper door frame 18 to seal the gap that will appear between the door frame 18 and the top of the slide section 42 as the slide section 42 is moved vertically downward. The top boot 90 has a cushioning seal 92 to facilitate the weather-proofing of the astragal assembly.

Figure 14:
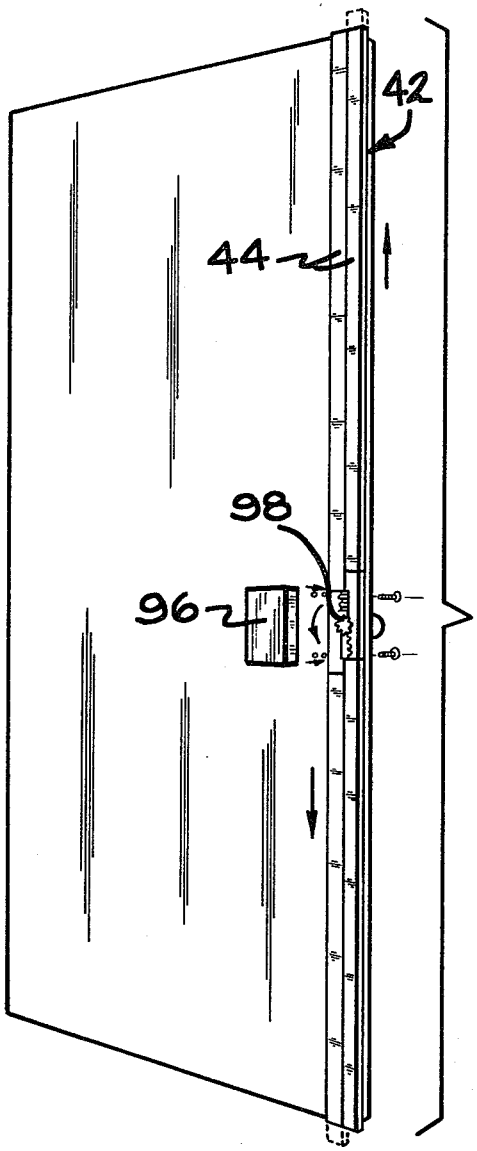
FIG. 14 is an alternate embodiment of the present invention.
Figure 13:
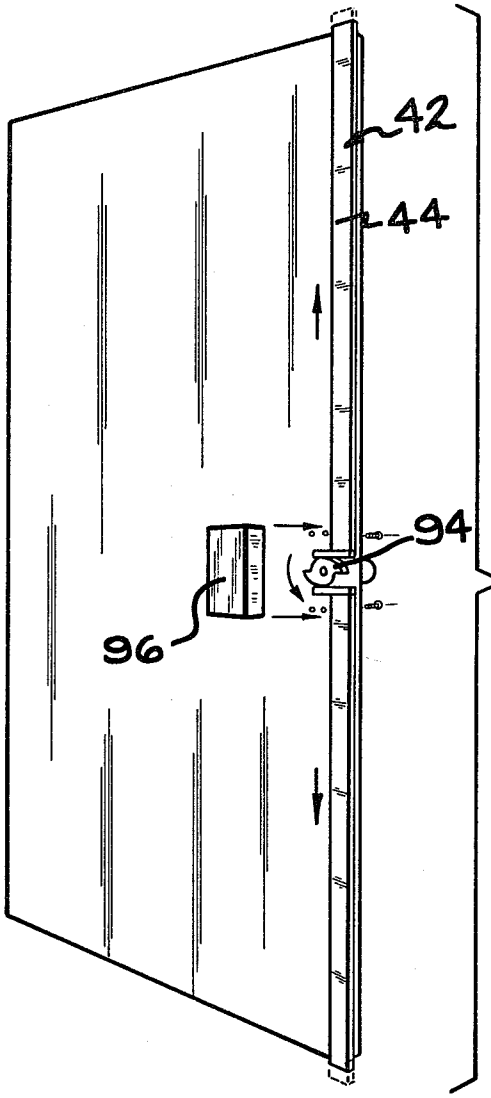
FIG. 13 is an alternate embodiment of the present invention.

Other embodiments of the astragal are shown in FIGS. 13 and 14. In FIG. 13 the facing member 44 of the slide section 42 is split to move simultaneously in an upward and downward direction to engage the upper door frame 18 and the door sill/threshold 16 as it is locked. This action is provided by a locking cam 94 which is covered by a locking boot 96.

FIG. 14 discloses yet another embodiment of the simultaneous upward and downward vertical movement of the slide section 42. In this instance the facing member is divided along its full vertical length to slide in an upward and downward position as it is locked. A geared lock 98 provides the necessary action and the geared lock 98 is covered by the locking boot 96.

The preferred embodiment of the astragal assembly can be unlocked to open the inactive door in the following manner. After the active door has been opened, the bolt member is moved into its unlocked position disengaging the strike plate in the upper door frame. As the bolt member is moved into its unlocked position, the cam member actuates against the cam surface of the locking latch, thereby moving the locking latch into its disengaged position with respect to the slide section. The slide section is then moved upward to disengage the door sill/threshold. Once the slide section is in its unlocked position, the inactive door can be opened.

It will be appreciated from the above description of the preferred embodiment of the improved astragal that various changes and modifications may be made without departing from the spirit and scope of the claimed invention.

What I claim is:

1. An improved astragal for use in a double door assembly having an active door and a relatively inactive door, such doors being pivotally mounted over a sill in a surrounding frame and having their free vertical edges adjacent one another, said astragal comprising: a vertically extending mullion housing positioned between the free vertical edges of such doors, said mullion housing being attached to such relatively inactive door, and a vertically extending slide section mounted on said mullion housing of such inactive door and adjacent the sealing sides of such inactive door and such active door when such active door is in the closed position, said slide section being vertically movable relative to said mullion housing between a locked position and an unlocked position.

2. An improved astragal as defined in claim 1, including a vertically extending sealing means on said slide section for engaging the sealing side of such active door when such active door is in the closed position.

3. An improved astragal as defined in claim 2, wherein said slide section further includes resilient means positioned between said slide section and said mullion housing for retaining said slide section in any given position with respect to said mullion housing.

4. An improved astragal as defined in claim 2, wherein said mullion housing includes a vertical locking means, said vertical locking means being vertically movable, relative to said mullion housing, between an unlocked position and a locked position.

5. An improved astragal as defined in claim 4, wherein said mullion housing includes: a vertically extending base member mounted on the free vertical edge of such inactive door; a first elongated leg integrally formed with said vertically extending base member adjacent the sealing side of the free edge of such inactive door and extending outwardly therefrom, said first elongated leg having an enlarged vertically extending ball member spaced from the free vertical edge of such inactive door; an elongated channel integrally formed with said vertically extending base member adjacent the sealing side of such inactive door, said elongated channel forming a vertically extending slot, a second elongated leg integrally formed with said vertically extending base member adjacent the back side of the free edge of such inactive door and extending outwardly therefrom; and a vertically extending mullion cap spaced from said base member and positioned between said first and second vertically extending elongated legs.

6. An improved astragal as defined in claim 5, wherein said vertical slide section includes: a vertically extending facing member spaced from the sealing side of such inactive door and the sealing side of such active door when such active door is in the closed position, a first elongated facing leg integrally formed with said vertically extending facing member, said first facing leg projecting towards such active door from said facing member; a second elongated facing leg integrally formed with said vertically extending facing member, said second facing leg having a first elongated side and a second elongated side, said first elongated side projecting towards such inactive door from said facing member, said second elongated side projecting from said first elongated side adjacent the sealing side of such inactive door, and a vertically extending socket integrally formed with said vertically extending facing member, said vertically extending socket member being positioned between said first and second elongated facing legs, whereby said vertically extending socket member engages said vertically extending ball member of said mullion housing and said vertically extending slot of said mullion housing engages said second elongated side of said second elongated facing leg of said facing member when said slide section is mounted on said mullion housing.

7. An improved astragal as defined in claim 6, wherein said vertically extending sealing means is positioned adjacent said first elongated facing leg, said facing member, and said socket member, said sealing means including a flexing member to engage the sealing side of such active door when such active door is in the closed position.

8. An improved astragal as defined in claim 7, wherein said vertical locking means is positioned in said mullion housing adjacent the top of such inactive door, said vertical locking means comprising: a bolt member, a guide means for retaining said bolt member in position to move vertically between a locked position and an unlocked position, said guide means includng: a guide plate contiguous with said mullion cap, said guide plate having a first spacing member and a second spacing member aligned to embrace said bolt member.

9. An improved astragal as defined in claim 8, wherein said guide means further includes: a first guide member and a second guide member, said first and second guide members each being positioned between said first and second spacing members.

10. An improved astragal as defined in claim 9, wherein said bolt member includes: a first aperture for receiving said first guide member and a second aperture for receiving said second guide member, means for moving said bolt member vertically with respect to said guide means, and a cam member.

11. An improved astragal as defined in claim 10, wherein said vertical locking means further includes: a locking latch having a cam surface for engaging said cam member of said bolt member, whereby, as said bolt member is moved to a locked position, said cam member engages said cam surface to place said locking latch into an interlocked position with said slide section and, as said bolt member is moved to an unlocked position, said cam member engages said cam surface to place said locking latch into a non-interlocking position with respect to said slide section.

12. An improved astragal as defined in claim 11, wherein a vertically extending trim member is fixed to said mullion housing to engage the back side of said inactive door and to engage the back side of said active door when said active door is in the closed position.

13. An improved astragal for use in a double door assembly having an active door and a relatively inactive door, such doors being pivotally mounted over a sill in a surrounding frame and having their free vertical edges adjacent one another, said astragal comprising: a vertically extending mullion housing positioned between the free vertical edges of such doors, said mullion housing being attached to such relatively inactive door; a vertically extending slide section mounted on said mullion housing of such inactive door and adjacent the sealing sides of such inactive door and such active door when such active door is in the closed position, said slide section being vertically movable relative to said mullion housing between a locked position and an unlocked position, said slide section further including a vertically extending sealing means having a flexing member to engage the sealing side of such active door when such active door is in the closed position; a resilient means positioned between said slide section and said mullion housing for retaining said slide section in any given position with respect to said mullion housing; a vertical locking means positioned in said mullion housing adjacent the top of such inactive door, said vertical locking means including a bolt member having a first aperture, a second aperture and a cam member, said vertical locking means further including a guide means having a guide plate contiguous with said mullion cap, said guide plate having a first spacing member and a second spacing member for aligning said bolt member to move vertically from a locked position to an unlocked position, a first guide member and a second guide member, each of said guide members being positioned on said guide plate between said first and second spacing members, whereby said first aperture on said bolt member receives said first guide member and said second aperture receives said second guide member, said vertical locking means also including a locking latch having a cam surface for engaging said cam member of said bolt member, said locking latch being fixed to pivot on said guide plate, whereby as said bolt member is moved to a locked position, said cam member engages said cam surface of said locking latch to pivot said locking latch to an interlocked position with said slide section, and as said bolt member is moved to an unlocked position, said cam member engages said cam surface of said locking latch to pivot said locking latch to a non-interlocking position with respect to said slide section; and a means for moving said bolt member vertically from a locked position to an unlocked position.

14. An improved astragal as defined in claim 13, wherein a vertically extending trim member is fixed to said mullion housing to engage the back side of said inactive door and to engage the back side of said active door when said active door is in the closed position.

* * * * *